United States Patent [19]

Otsuka et al.

[11] 4,367,713

[45] Jan. 11, 1983

[54] AIR/FUEL RATIO CONTROL SYSTEM FOR INTERNAL COMBUSTION ENGINES, HAVING AIR/FUEL CONTROL FUNCTION AT ENGINE DECELERATION

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 282,416

[22] Filed: Jul. 13, 1981

[30] Foreign Application Priority Data

Jul. 21, 1980 [JP] Japan ..... 55-99481

[51] Int. Cl.[3] ..... F02M 7/00; F02G 3/00; F02B 33/00; F02M 11/00

[52] U.S. Cl. ..... 123/440; 123/494

[58] Field of Search ..... 123/494, 440; 371/438, 371/389, 371; 60/276, 285; 137/533.17; 251/129, 141

[56] References Cited

U.S. PATENT DOCUMENTS

| | | | |
|---|---|---|---|
| 4,131,088 | 12/1978 | Reddy | 123/494 |
| 4,169,441 | 10/1979 | Hirano et al. | 123/440 |
| 4,181,108 | 1/1980 | Bellicardi | 123/440 |
| 4,239,028 | 12/1980 | Kimata et al. | 123/440 |
| 4,279,230 | 7/1981 | Bauer et al. | 123/440 |
| 4,287,864 | 9/1981 | Takada et al. | 123/440 |
| 4,290,404 | 9/1981 | Hata et al. | 123/440 |

*Primary Examiner*—Raymond A. Nelli
*Attorney, Agent, or Firm*—Lyon & Lyon

[57] ABSTRACT

An air/fuel ratio control system for feedback control of the air/fuel ratio of a mixture being supplied to an internal combustion engine is provided which comprises an absolute pressure sensor for detecting the absolute pressure in the intake pipe of the engine, and means operable to interrupt the air/fuel feedback control operation and immediately move an actuator for driving an air/fuel ratio control valve to a predetermined position and hold it there when the absolute pressure in the intake pipe, detected by the absolute pressure sensor is lower than a predetermined value at engine deceleration. This arrangement can ensure best driveability and best exhaust gas emission characteristics of the engine at engine deceleration.

2 Claims, 3 Drawing Figures

1
2
3
4
5
6
7₁
7₂
8₁
8₂
8₃
8₄
9
10
10a
11
11a
12
13
14
15
16
17
18
20
21
22
23
24
25
26
27₁
27₂
28
29
30
31
32
33
34
35
36
37
38
39

AIR/FUEL RATIO CONTROL SYSTEM FOR INTERNAL COMBUSTION ENGINES, HAVING AIR/FUEL CONTROL FUNCTION AT ENGINE DECELERATION

BACKGROUND OF THE INVENTION

This invention relates to an air/fuel ratio control system for feedback control of the air/fuel ratio of a mixture being supplied to an internal combustion engine, and more particularly to a device provided in such system for effecting air/fuel ratio control during deceleration of the engine.

An air/fuel ratio control system is already known which carries out feedback control of the air/fuel ratio of a mixture being supplied to an internal combustion engine by driving by means of a pulse motor an air/fuel ratio control valve which is arranged to control the air/fuel ratio of the mixture produced by the carburetor, in response to a signal outputted from an $O_2$ sensor made of zirconium oxide or a like material and provided in the exhaust system of the engine for detecting the concentration of oxygen present in the exhaust gas.

When the throttle valve is suddenly closed to decelerate the engine, there occurs a sudden decrease in the intakeair quantity to cause a corresponding drop in the intake pressure (absolute pressure) in the intake manifold, namely, a corresponding increase in the intake negative pressure. As a consequence, the mixture becomes too rich to cause incomplete combustion within engine cylinders so that the exhaust gas contains unburned HC in large quantities.

If the above-mentioned air/fuel ratio control system continues its feedback control operation during such engine deceleration, the proper concentration of oxygen present in the exhaust gas cannot be detected with accuracy by the $O_2$ sensor provided in the exhaust system, owing to the increased unburned HC, which makes it impossible to control by means of feedback the air/fuel ratio of the mixture to the theoretical value with accuracy.

OBJECT AND SUMMARY OF THE INVENTION

It is therefore the object of the invention to provide an air/fuel ratio control system for use with an internal combustion engine, which is provided with an air/fuel ratio control function during engine deceleration which comprises temporarily interrupting the air/fuel ratio feedback control operation when the absolute pressure in the intake pipe drops below a predetermined value at engine deceleration, and immediately moving the actuator for the air/fuel ratio control valve to a predetermined position appropriate for the decelerated state of the engine and holding it there. By virtue of this function, it can be avoided that the actuator is driven to positions which would be then inappropriate for the operating condition of the engine owing to increased unburned HC in the exhaust gases when the engine is decelerated for a long period of time, to thereby obtain best exhaust gas emission characteristics of the engine.

According to the invention, there is provided an air/fuel ratio control system for performing feedback control of the air/fuel ratio of an air/fuel mixture being supplied to an internal combustion engine, which includes an $O_2$ sensor for detecting the concentration of oxygen present in exhaust gas emitted from the engine, fuel quantity adjusting means for producing said air/fuel mixture being supplied to the engine, and means operatively connecting said $O_2$ sensor with said fuel quantity adjusting means in a manner effecting feedback control operation in response to an output signal produced by the $O_2$ sensor to control the air/fuel ratio of said air/fuel mixture to a preset value. The system is characterized by comprising in combination an absolute pressure sensor for detecting absolute pressure in an intake pipe provided in the engine, first means connected to the absolute pressure sensor for producing a signal for interrupting the feedback control operation when the absolute pressure in the intake pipe, detected by said absolute pressure sensor is lower than a predetermined value, second means responsive to said feedback control interrupting signal to interrupt the feedback control operation, and third means responsive to said feedback control interrupting signal to operate to cause said fuel quantity adjusting means to supply an air/fuel mixture having a predetermined air/fuel ratio to the engine. The first, second and third means form part of the above-mentioned connecting means.

The above and other objects, features and advantages of the invention will be more apparent from the ensuing detailed description taken in connection with the accompanying drawings in which:

DETAILED DESCRIPTION

The air/fuel ratio control system according to the invention will now be described in detail with reference to the accompanying drawings wherein an embodiment of the invention is illustrated.

Figure 1:
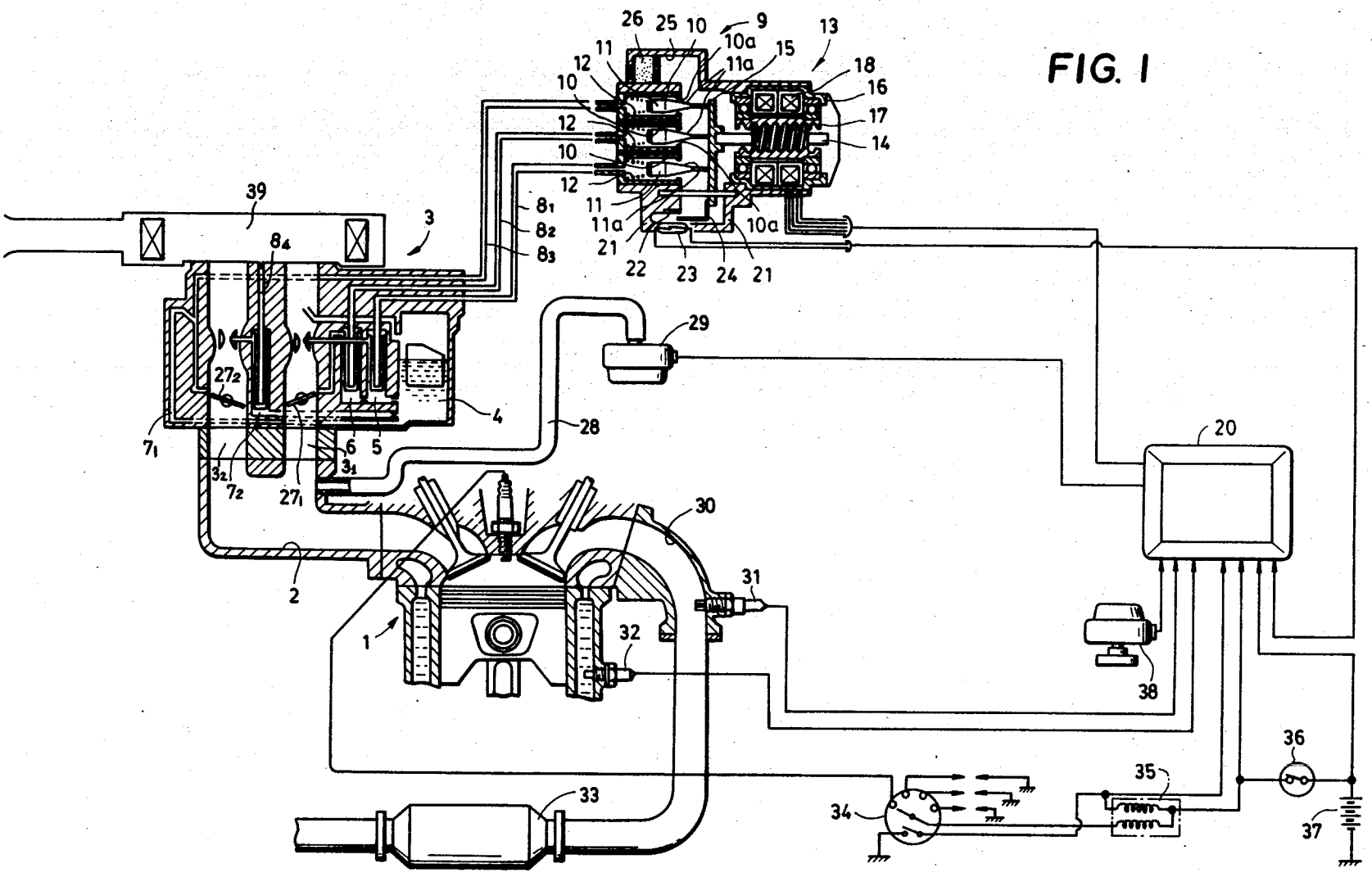
FIG. 1 is a diagrammatical diagram of the whole arrangement of an air/fuel ratio control system according to an embodiment of the present invention.

Referring now to FIG. 1, there is illustrated the whole system of the invention. Reference numeral 1 designates an internal combustion engine. Connected to the engine 1 is an intake manifold 2 which is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passsage $8_3$ and, on the other hand, opens in the secondary bore at a location slightly upstream of a throttle valve $27_2$ in the secondary bore. The fuel passage $7_2$ communicates with the interior of an air cleaner 39 via an air passage $8_4$ having a fixed orifice. The control valve 9 is comprised of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about its own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenoid 18 is energized by driving pulses supplied from ECU 20 to cause rotation of the rotor 17 which in turn causes movement of the worm element 14 threadedly engaging the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. Thee magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, a pressure sensor (absolute pressure sensor) 29 is connected to an intake manifold 2 communicating with the engine 1, by way of a conduit 28 opening at its end in the intake manifold 2 at a zone downstream of a throttle valve $27_1$ in the manifold 2, to detect the absolute pressure in the intake manifold 2. The pressure sensor 29 has its output electrically connected to ECU 20 to supply an output signal indicative of a detected absolute pressure value thereto.

An $O_2$ sensor 31, which may be made of stabilized zirconium oxide or the like, is mounted at an exhaust manifold 30 communicating with the engine 1 in a manner partly projecting in the manifold 30, to detect the concentration of oxygen present in the exhaust gas emitted from the engine 1. Also this $O_2$ sensor 31 has its output electrically connected to ECU 20 to supply an output signal indicative of a detected oxygen concentration value thereto.

In FIG. 1, reference numeral 32 designates a thermistor partly inserted in the peripheral wall of a cylinder of the engine the interior of which wall is filled with engine cooling water. The detected value signal produced by the thermistor 32 is supplied to ECU 20. Reference numeral 33 designates a three-way catalyst for purifying HC, CO and NOx present in the exhaust gas, 34 a distributor, 35 ignition coils, 36 an ignition switch which also serves as the power switch of ECU 20, 37 a car battery which also serves as the power supply for ECU 20, and 38 an atmospheric pressure sensor, respectively. The atmospheric pressure sensor 38 may be mounted within ECU 20.

Details of the air/fuel ratio control which can be performed by the air/fuel ratio control system according to the invention will now be described by reference to FIG. 1 which has been referred to hereinabove.

INITIALIZATION

Referring first to the initialization, when the ignition switch 36 in FIG. 1 is set on, ECU 20 is initialized to detect the reference position of the actuator or pulse motor 13 by means of the reed switch 23 and hence drive the pulse motor 13 to set it to its best position (a preset position) for starting the engine, that is, set the initial air/fuel ratio to a predetermined proper value. The above preset position of the pulse motor 13 is hereinafter called "$PS_{CR}$." This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Than, ECU 20 monitors the condition of activation of the $O_2$ sensor 31 and the coolant temperature Tw detected by the thermistor 32 to determine whether or not the engine is in a condition for initiation of the air/fuel ratio control. For accurate air/fuel ratio feedback control, it is a requisite that the $O_2$ sensor 31 is fully activated and the engine is in a warmed-up condition. The $O_2$ sensor, which is made of stabilized zirconium dioxide or the like as previously mentioned, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions are fulfilled that the sensor produces an activation signal when its output voltage lowers down to a predetermined voltage Vx, a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate positions in response to the operating condition of the engine after initiation of the air/fuel ratio control, as hereinlater described.

BASIC AIR/FUEL RATIO CONTROL

Following the initialization described above, the program proceeds to the basic air/fuel ratio control.

ECU 20 is responsive to various detected value signals representing the output voltage of the $O_2$ sensor 31, the absolute pressure in the intake manifold 2 detected by the pressure sensor 29, the engine rpm Ne detected by the rpm sensor 34, 35 and the atmospheric pressure $P_A$ detected by the atmospheric pressure sensor 38, to drive the pulse motor 13 as a function of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A-P_B$ (gauge pressure) between the absolute pressure $P_B$ detected by the pressure sensor 29 and the atmospheric pressure $P_A$ (absolute pressure) detected by the atmospheric pressure sensor 38 is lower than a predetermined value $\Delta P_{WOT}$. ECU 20 compares the difference in value between the output signals of the sensors 29, 38 with the predetermined value $\Delta P_{WOT}$ stored therein, and when the relationship of $P_A-P_B<\Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 34, 35 with the predetermined rpm $N_{IDL}$ stored therein, and when the relationship of $Ne<N_{IDL}$ stands, drives the pulse motor 13 to a predetermined idle position (preset position) $PS_{IDL}$ which is best suitable for the engine emissions and holds it there.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 29 with the predetermined value $PB_{DEC}$ stored therein, and when the relationship of $P_B<PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold 2 drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value, as previously mentioned. Therefore, according to the invention, the open loop control is employed, as noted above, when the absolute pressure $P_B$ in the intake manifold detected by the pressure sensor 29 is smaller than the predetermined value $PB_{DEC}$, where the pulse motor is set to the predetermined position $PS_{DEC}$ best suitable for the engine driveability and engine emissions obtained at the time of termination of the deceleration open loop control. At the beginning of engine deceleration, a shot air valve, not shown, is actuated to supply air into the intake manifold to prevent the occurrence of unburned ingredients in the exhaust gas.

During operations of the above-mentioned open loop control at wide-open-throttle, at engine idle, at engine deceleration, the respective predetermined positions $PS_{WOT}$, $PS_{IDL}$, $PS_{DEC}$ for the pulse motor 13 are compensated for atmospheric pressure $P_A$, as hereinlater described.

On the other hand, the condition of closed loop control at engine partical load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 34, 35 and the output signal of the $O_2$ sensor 31. To be concrete, the integral term correction is used when the output voltage of the $O_2$ sensor 31 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor 31 is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner prompter and more efficient than the integral term correction.

As noted above, according to the above I term control, the pulse motor position is varied by an integral value by integrating the value of a binary signal corresponding to the change of the output voltage of the $O_2$ signal. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine acceleration (i.e., off-idle acceleration) is carried out when the engine rpm Ne exceeds the aforementioned predetermined idle rpm $N_{IDL}$ during the course of the engine speed increasing from a low rpm range to a high rpm range, that is, when the engine speed changes from a relationship Ne<-

$N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinlater described.

The above-mentioned predetermined position $PS_{ACC}$ is set at a position where the amount of detrimental ingredients in the exhaust gas is small. Therefore, particularly at the so-called "standing start," i.e., acceleration from a vehicle-stopping position, setting the pulse motor position to the predetermined position $PS_{ACC}$ is advantageous to anti-exhaust measures, as well as to achievement of accurate air/fuel ratio feedback control to be done following the acceleration. This acceleration control is carried out under a warmed-up engine condition, too.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to ressume early accurate air/fuel ratio control and accordingly ensure highly stable engine emissions.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of Ci at a suitable value, since the pulse motor position held during open loop control forms an initial position upon entering subsequent closed loop control.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impede proper setting of the air/fuel ratio during open loop control where the actual position of the pulse motor 13 must be accurately recognized by ECU 20.

In view of the above disadvantage, according to the air-fuel ratio control system of the invention, as previously mentioned, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

Figure 2:
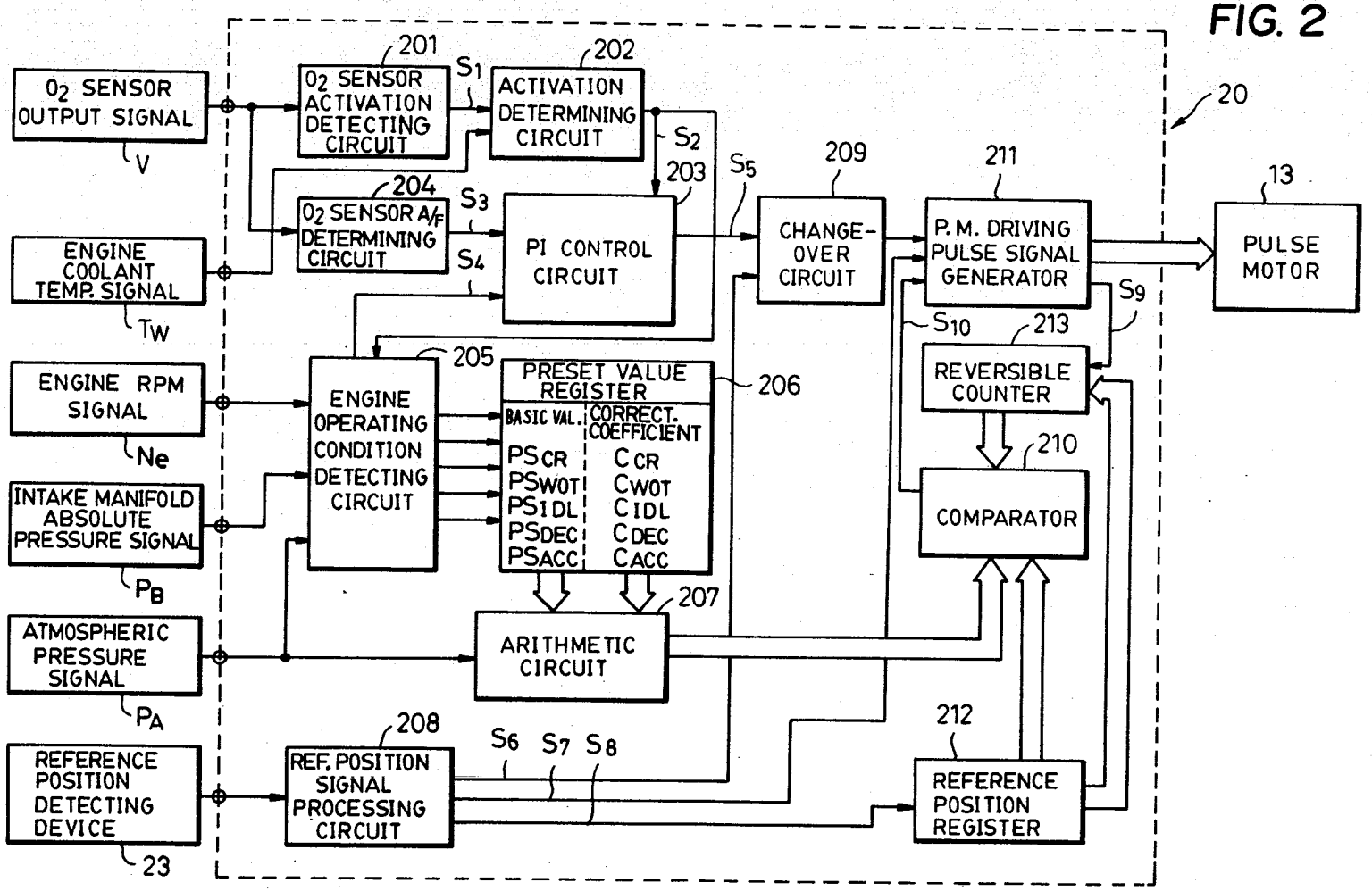
FIG. 2 is a block diagram of the whole arrangement of an electrical circuit provided in the electronic control unit shown in FIG. 1.

FIG. 2 is a block diagram illustrating the interior construction of ECU 20 used in the air/fuel ratio control system having the above-mentioned functions according to the invention. In ECU 20, reference numeral 201 designates a circuit for detecting the activation of the $O_2$ sensor, which is supplied at its input with an output signal V from the $O_2$ sensor. Upon passage of the predetermined period of time Tx after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from the thermistor 32 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel ratio determining circuit which determines the value of air/fuel ratio of engine exhaust gas, depending upon whether or not the output voltage of the $O_2$ sensor 31 is larger than the predetermined value Vref, to supply a binary signal $S_3$ indicative of the value of air/fuel ratio thus obtained, to the PI control circuit 203. On the other hand, an engine condition detecting circuit 205 is provided in ECU 20, which is supplied with an engine rpm signal Ne from the engine rpm sensor 34, 35, an absolute pressure signal $P_B$ from the pressure sensor 29, an atmospheric pressure signal $P_A$ from the atmospheric pressure sensor 38, all the sensors being shown in FIG. 1, and the above control initiation signal $S_2$ from the activation determining circuit 202 in FIG. 2, respectively. The circuit 205 supplies a control signal $S_4$ indicative of a value corresponding to the values of the above input signals to the PI control circuit 203. The PI control circuit 203 accordingly supplies to a change-over circuit 209 to be refered to later a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine condition detecting circuit 205. The engine condition detecting circuit 205 also supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine condition detecting circuit 205, the PI control circuit 203 interrupts its own operation. Upon interruption of the supply of the above signal component to the control circuit 203, a pulse signal $S_5$ is outputted from the circuit 203 to the change-over circuit 209, which signal starts air/fuel ratio control with integral term correction. A preset value register 206 is provided in ECU 20, in which are stored the basic values of preset values $PS_{CR}$, $PS_{WOT}$, $PS_{IDL}$, $PS_{DEC}$ and $PS_{ACC}$ for the pulse motor position, applicable to various engine conditions, and atmospheric pressure correcting coefficients $C_{CR}$, $c_{WOT}$, $C_{IDL}$, $C_{DEC}$ and $C_{ACC}$ for these basic values. The engine condition detecting circuit 205 detects the operating condition of the engine based upon the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi\ (P_A)=PSi+(760-P_A)\times Ci$. The resulting preset value is applied to a comparator 210.

On the other hand, a reference position signal processing circuit 208 is provided in ECU 20, which is responsive to the output signal of the reference position detecting device (reed switch) 23, indicative of the switching of same, to produce a binary signal $S_6$ having a certain level from the start of the engine until it is detected that the pulse motor reaches the reference position. This binary signal $S_6$ is supplied to the change-over circuit 209 which in turn keeps the control signal $S_5$ from being transmitted from the PI control circuit 203 to a pulse motor driving signal generator 211 as long as it is supplied with this binary signal $S_6$, thus avoiding the interference of the operation of setting the pulse motor to the initial position with the operation of P-term/I-term control. The reference position signal processing circuit 208 also produces a pulse signal $S_7$ in response to the output signal of the reference position detecting device 23, which signal causes the pulse motor 13 to be driven in the step-increasing direction or in the step-decreasing direction so as to detect the reference position of the pulse motor 13. This signal $S_7$ is supplied directly to the pulse motor driving signal generator 211 to cause same to drive the pulse motor 13 until the reference position is detected. The reference position signal processing circuit 208 produces another pulse signal $S_8$ each time the reference position is detected. This pulse signal $S_8$ is supplied to a reference position register 212 in which the value of the reference position (e.g., 50 steps) is stored. This register 212 is responsive to the above signal $S_8$ to apply its stored value to one input terminal of the comparator 210 and to the input of a reversible counter 213. The reversible counter 213 is also supplied with an output pulse signal $S_9$ produced by the pulse motor driving signal generator 211 to count the pulses of the signal $S_9$ corresponding to the actual position of the pulse motor 13. When supplied with the stored value from the reference position register 212, the counter 213 has its counted value replaced by the value of the reference position of the pulse motor.

The counted value thus renewed is applied to the other input terminal of the comparator 210. Since the comparator 210 has its other input terminal supplied with the same pulse motor reference position value, as noted above, no output signal is supplied from the comparator 210 to the pulse motor driving signal generator 211 to thereby hold the pulse motor at the reference position with certainty. Subsequently, when the $O_2$ sensor 31 remains deactivated, an atmospheric pressure-compensated preset value $PS_{CR}(P_A)$ is outputted from the arithmetic circuit 207 to the one input terminal of the comparator 210 which in turn supplies an output signal $S_{10}$ corresponding to the difference between the preset value $PS_{CR}(P_A)$ and a counted value supplied from the reversible counter 213, to the pulse motor driving signal generator 211, to thereby achieve accurate control of the position of the pulse motor 13. Also, when the other open loop control conditions are detected by the engine condition detecting circuit 205, similar operations to that just mentioned above are carried out.

Figure 3:
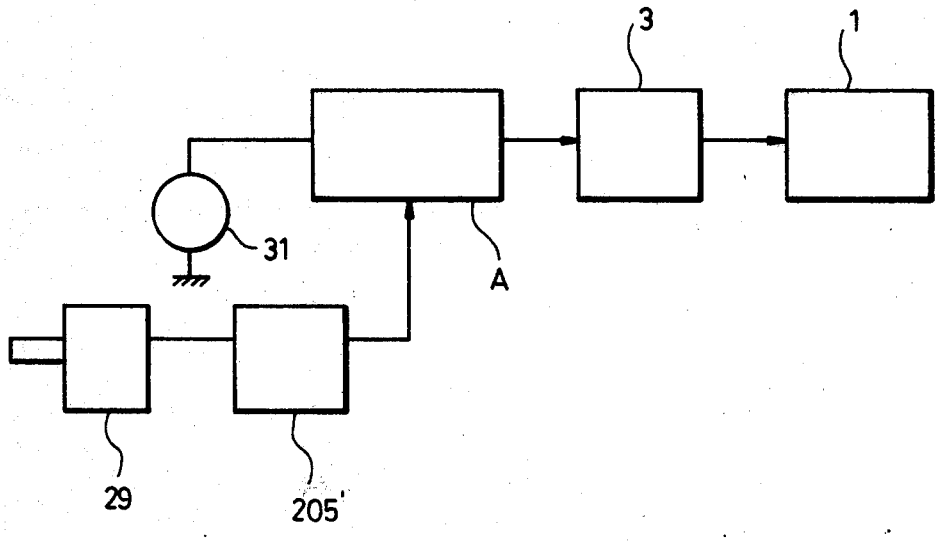
FIG. 3 is a block diagram of a deceleration control arrangement according to the present invention.

FIG. 3 is a block diagram of a deceleration control arrangement according to the invention for carrying out air/fuel ratio control during engine deceleration. The $O_2$ sensor 31 in FIG. 1 is connected to an air/fuel ratio feedback control section A which includes the circuits 203, 206, 207, 209 through 213 in FIG. 2, the pulse motor 13, etc. The section A has its output connected to a fuel quantity adjusting device, e.g., the carburetor 3 in FIG. 1 which is operatively connected to the engine 1. The pressure sensor 29 in FIG. 1 is connected to a predetermined value detecting device 205' which may comprise a suitable comparator. This detecting device 205' forms part of the engine operating condition detecting circuit 205 in FIG. 2. The device 205' has its output connected to the feedback control section A.

The operation of the above deceleration control arrangement is as follows. The air/fuel ratio control feedback section A is supplied with a signal from the $O_2$ sensor 31, which is indicative of the oxygen concentration in the exhaust manifold, detected thereby. The section A is responsive to this detected value signal to drive the pulse motor 13 in FIG. 1 in the manner previously described to supply the engine 1 with a mixture having an air/fuel ratio best suited for the operating condition of the engine 1 through the carburetor 3.

Now, when the engine 1 is decelerated, the predetermined value detecting device 205' compares the value of a signal $P_B$ outputted from the pressure sensor 29, indicative of the absolute pressure in the intake manifold 2, detected by the sensor 29, with a predetermined value $p_{BDEC}$ (e.g., 210 mmHg) stored therein. When the former value $P_B$ is lower than the latter value $P_{BDEC}$, the detecting device 205' produces a feedback control interrupting signal which is supplied to the air/fuel ratio control section A. The control section A is responsive to this feedback control interrupting signal to operate to interrupt the above-mentioned feedback control operation and immediately drive the pulse motor 13 to the predetermined deceleration position $PS_{DEC}$ (e.g., 40th step) and hold it there.

When the operating condition of the engine 1 changes from the decelerated condition to another condition so that the value of the absolute pressure signal $P_B$ produced by the pressure sensor 29 exceeds the predetermined value $P_{BDEC}$ stored in the predetermined value detecting device 205', the detecting device 205' operates to interrupt the supply of the above feedback control interrupting signal to the control section A. After this, the control section A operates in response to the operating condition of the engine 1 to carry out air/fuel ratio control operation by closed loop or by open loop in dependence upon the engine operating condition then assumed by the engine, in the manner previously described.

As set forth above, the air/fuel ratio control system according to the invention is arranged to temporarily interrupt the feedback control operation when the engine comes into such a decelerated state that the absolute pressure in the intake manifold 2 drops below a predetermined value at which there occurs a conspicuous increase in the amount of unburned HC in the exhaust gases, and immediately move the pulse motor to a position best suited for the decelerated state of the engine and hold it there. This can prevent the pulse motor from being driven to position which would be inappropriate to the engine operating condition owing to increased unburned HC in the exhaust gases particularly after the engine has been decelerated for a long period of time, thus maintaining good exhaust gas emission characteristics of the engine even at engine deceleration.

What is claimed is:

1. In an air/fuel ratio control system for performing feedback control of the air/fuel ratio of an air/fuel mixture being supplied to an internal combustion engine, including an $O_2$ sensor for detecting the concentration of oxygen present in exhaust gas emitted from said engine, fuel quantity adjusting means for producing said air/fuel mixture being supplied to said engine, and means operatively connecting said $O_2$ sensor with said fuel quantity adjusting means in a manner effecting feedback control operation in response to an output signal produced by said $O_2$ sensor to control the air/fuel ratio of said air/fuel mixture to a preset value, the combination comprising: an absolute pressure sensor for detecting absolute pressure in an intake pipe provided in said engine, first means connected to said absolute pressure sensor for producing a signal for interrupting said feedback control operation when the absolute pressure in said intake pipe, detected by said absolute pressure sensor is lower than a predetermined value, second means responsive to said feedback control interrupting signal to interrupt said feedback control operation, and third means responsive to said feedback control interrupting signal to operate to cause said fuel quantity adjusting means to supply an air/fuel mixture having a predetermined air/fuel ratio to said engine, said first, second and third means forming said connecting means.

2. The air/fuel ratio control system as claimed in claim 1, wherein said connecting means further comprises valve means for controlling the air/fuel ratio of said air/fuel mixture, and actuator means for driving said valve means, wherein said third means is operatively connected to said actuator means for driving same to a predetermined position for causing said valve means to achieve said predetermined air/fuel ratio of said air/fuel mixture.

* * * * *

UNITED STATES PATENT AND TRADEMARK OFFICE

CERTIFICATE OF CORRECTION

PATENT NO. : 4,367,713

DATED : January 11, 1983

INVENTOR(S) : Kazuo Otsuka et al

It is certified that error appears in the above—identified patent and that said Letters Patent is hereby corrected as shown below:

Col. 1, line 20, change "a signal outputted" to read --an output signal--.

Col. 1, line 55, change "it can be avoided that the actuator is" to read --the actuator will not be--.

Col. 2, line 27, delete "diagrammatical".

Col. 3, lines 56 and 63, change "in" to read --into-- both places.

Col. 4, line 14, change "is set on" to read --is turned on--.

Col. 4, line 32, change "Than" to read --Then--.

Col. 4, line 60, change "an opening for enabling" to read --a degree for accomplishing--.

Col. 5, line 35, delete "or small".

Col. 5, line 56, change "ground for this condition" to read --reason establishing this feature--.

Col. 6, line 15, correct spelling of "partial".

Col. 6, line 47, change "signal" to read --sensor--.

Col. 7, line 48, correct spelling of "resume".

Col. 9, line 19, correct spelling of "referred" and after "later" change "a" to --as--.

UNITED STATES PATENT AND TRADEMARK OFFICE

CERTIFICATE OF CORRECTION

PATENT NO. : 4,367,713

DATED : January 11, 1983

INVENTOR(S) : Kazuo Otsuka et al

It is certified that error appears in the above—identified patent and that said Letters Patent is hereby corrected as shown below:

Col. 9, line 42, change "$c_{wot}$" to --$C_{wot}$--.

Col. 11, line 13, change "$p_{BDEC}$" to --$P_{BDEC}$--.

Signed and Sealed this

*Fifth* Day of *April 1983*

[SEAL]

*Attest:*

GERALD J. MOSSINGHOFF

*Attesting Officer*

*Commissioner of Patents and Trademarks*